US009899767B1

(12) United States Patent
Juds et al.

(10) Patent No.: US 9,899,767 B1
(45) Date of Patent: Feb. 20, 2018

(54) CONNECTOR WITH CLOCKABLE INTEGRATED POWER SWITCHING

(71) Applicant: Eaton Corporation, Cleveland, OH (US)

(72) Inventors: Mark Allan Juds, New Berlin, WI (US); Kaushik Naidu Kona, Andhra pradesh (IN); Karthik Satyanarayanan, Tamilnadu (IN); Abhijeet Rathi, Dist-Buldhana (IN)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 15/392,455

(22) Filed: Dec. 28, 2016

(51) Int. Cl.

| | |
|---|---|
| ***H01R 27/00*** | (2006.01) |
| ***H01R 31/06*** | (2006.01) |
| ***H01R 13/629*** | (2006.01) |
| ***H01R 13/627*** | (2006.01) |

(52) U.S. Cl.
CPC ..... *H01R 13/629* (2013.01); *H01R 13/627* (2013.01)

(58) Field of Classification Search
CPC ..... H01R 27/00; H01R 31/06
USPC ..... 439/171, 173, 174
See application file for complete search history.

(56) References Cited

U.S. PATENT DOCUMENTS

| | | | | |
|---|---|---|---|---|
| 3,330,920 | A | 7/1967 | Appleton | |
| 3,500,291 | A | 3/1970 | Hubbell et al. | |
| 3,853,376 | A | 12/1974 | Marechal | |
| 3,982,804 | A | 9/1976 | Marechal | |
| 4,249,787 | A | 2/1981 | Welu | |
| 4,525,610 | A | 6/1985 | Le Magourou | |
| 4,553,000 | A | 11/1985 | Appleton | |
| 5,234,350 | A | 8/1993 | Marechal et al. | |
| 5,417,595 | A | 5/1995 | Cullen et al. | |
| 5,697,798 | A | 12/1997 | Marechal | |
| 6,328,581 | B1 * | 12/2001 | Lee | H01R 31/06 439/106 |
| 6,382,990 | B1 | 5/2002 | Marechal et al. | |
| 7,182,614 | B2 | 2/2007 | Crestin | |
| 7,491,080 | B2 | 2/2009 | Alami et al. | |
| 7,946,868 | B1 * | 5/2011 | Chen | H01R 13/625 439/173 |
| 8,414,318 | B1 * | 4/2013 | Chen | H01R 35/04 439/173 |
| 8,579,656 | B2 * | 11/2013 | Huang | H01R 31/06 439/171 |
| 8,686,683 | B2 * | 4/2014 | Caskey | H01R 13/6675 320/107 |
| 8,876,541 | B1 * | 11/2014 | Wu | H01R 27/00 439/173 |
| 2009/0280665 | A1 * | 11/2009 | Yang | H01R 24/68 439/173 |

(Continued)

*Primary Examiner* — Gary Paumen
(74) *Attorney, Agent, or Firm* — Eckert Seamans; David Jenkins; Grant Coffield

(57) ABSTRACT

A power connector receptacle includes a housing assembly and a clockable contact assembly. The housing assembly includes a first housing including a hollow, elongated body. The first housing body is structured to be coupled to the number of first electrical couplings disposed in a variable standard pattern. The clockable contact assembly is structured to be disposed substantially within the housing assembly first housing body and coupled thereto in one of a plurality of possible orientations.

17 Claims, 7 Drawing Sheets

(56) References Cited

U.S. PATENT DOCUMENTS

| | | | | |
|---|---|---|---|---|
| 2010/0120278 | A1* | 5/2010 | Yang | H01R 35/04<br>439/171 |
| 2010/0165569 | A1* | 7/2010 | Lai | G06F 1/1616<br>361/679.55 |
| 2014/0127926 | A1 | 5/2014 | Condo et al. | |

* cited by examiner

CONNECTOR WITH CLOCKABLE INTEGRATED POWER SWITCHING

BACKGROUND OF THE INVENTION

Field of the Invention

The disclosed concept pertains generally to power connectors and, more particularly, to a power connector including a housing with a variable orientation contact assembly mounting and a clockable contact assembly.

Background Information

Power connectors are used in many different electrical applications, such as, for example, in commercial applications (e.g., employed with stoves and fryers) and in shipping industries (e.g., with refrigeration equipment). Typically, power connectors include a line side receptacle, which is electrically connected to a power source, and a load side receptacle. The line side receptacle has a number of electrical couplings in the form of metallic sleeves. The load side receptacle has a number of electrical couplings in the form of metallic pins. In operation, the pins are inserted into the sleeves in order to provide an electrical pathway between the line side receptacle and the load side receptacle.

A power connector includes a non-conductive housing assembly. That is, each line/load receptacle includes a non-conductive housing. The line/load receptacle housings generally correspond in size and shape and, in an exemplary embodiment, are generally cylindrical and generally enclose the electrical couplings (sleeves and pins). That is, the electrical couplings (sleeves and pins) are exposed at one axial end of the line/load receptacle housings so that, when the line/load receptacle housings are brought together, the pins are inserted into the sleeves. Further, each electrical coupling (sleeve and pin) is disposed at a specific location, e.g., the "three o'clock" position. That is, with a generally cylindrical housing, the face where the electrical couplings (sleeves and pins) are exposed is similar to a clock and each electrical coupling (sleeves and pins) is described as being at a selected location. It is noted that the associated coupling, i.e., the couplings that mate when the line side receptacle and the load side receptacle are brought together, are disposed in mirrored positions. For example, if the female (sleeve) coupling for the ground conductor is disposed at the "three o'clock" position, then the male (pin) coupling for the ground conductor is disposed at the "nine o'clock" position. It is understood that when a coupling, e.g., the ground coupling, is at either the "twelve o'clock" position or the "six o'clock" position, the associated coupling is also at that position. That is, the various positions are mirrored about a vertical axis, i.e., the axis extending between the "twelve o'clock" position and the "six o'clock" position. Further, the "o'clock" positions are disposed about 30° apart. Finally, it is noted that those of skill in the art describe a power connector by the (clock face) position of the ground coupling. That is, a power connector is described as a "three o'clock" connector when the female (sleeve) ground coupling is at the "three o'clock" position. The convention of identifying a specific configuration by identifying the location of the ground coupling will be used hereinbelow.

Power connectors are made in a variety of configurations, with each configuration associated with a specific voltage, a specific number of conductors, i.e., a specific number of sleeve/pins, and the type of power supply, e.g., AC or DC. Moreover, for each configuration, the electrical couplings (sleeves and pins) are disposed in one of a number of standard patterns. That is, a selected line side power connector (i.e., the female or sleeve side) has a configuration with the following characteristics: it is a 480 volt AC connection that includes five sleeves, four power conductors and one ground conductor, with the ground sleeve disposed at the seven o'clock position. It is understood that, on the load side connector, a ground pin is disposed at the five o'clock position as that is the "mirrored" location, as discussed above. Conversely, another power connector has a configuration with the following characteristics: it is a 250 volt DC connection that includes three sleeves, two power conductors and one ground conductor, with the ground sleeve disposed at the three o'clock position. It is understood that, on the load side connector, a ground pin is disposed at the nine o'clock position as that is the "mirrored" location, as discussed above. Thus, often the number of electrical couplings (sleeves and pins) is different for different configurations and the positions of the electrical couplings (sleeves and pins) are different as well. Further, even when the power connectors include a specific number of electrical couplings (sleeves and pins), the electrical couplings (sleeves and pins) are disposed in different patterns for different ratings, i.e., different voltage and number of conductors. Thus, it is difficult, if not impossible, to couple receptacles for a line and load where the receptacles do not have electrical couplings (sleeves and pins) disposed in a corresponding standard pattern. It is noted that power connectors for different amperages have different sizes as well as pins/sleeves of different sizes. Generally, the greater the amperage, the larger the power connector and the larger the pins/sleeves. Thus, power connectors for different amperages cannot be coupled to each other.

Further, for safety, as well as other reasons, one of the receptacles includes a contact assembly. The contact assembly includes a number of line-side contacts, a number of load-side contacts, a number of movable conductor members, and an operating mechanism. Each conductor member is associated with one line-side contact and one load-side contact. Each conductor member is movable between a first position, wherein the associated line-side contact and the associated load-side contact are not in electrical communication, and, a second position, wherein the associated line-side contact and the associated load-side contact are in electrical communication. The operating mechanism is structured to, and does, move between a first position and a second position wherein, when the operating mechanism is in the first position, the movable conductor members are in the first position, and, when the operating mechanism is in the second position, the movable conductor members are in the second position. That is, the operating mechanism is structured to, and does, move the movable conductor members. One set of contacts (line or load) are coupled to, and are in electrical communication with, the electrical couplings (sleeves or pins) of the housing in which the contact assembly is disposed.

In operation, the operating mechanism is placed in the first position prior to coupling the line/load receptacle housings. Thus, when the receptacles are joined, electricity does not immediately flow to the load. Instead, the receptacles are joined thereby substantially enclosing electrical couplings (sleeves and pins) within the joined housings. The contact assembly is then actuated so as to move the conductor members to the second position and allow electricity to flow to the load.

One disadvantage to this system is that each receptacle is made for a current with a specific rating. As used herein, a "rating" relates to the voltage and the number of conductors. That is, as discussed above, a power connector with a specific "rating" has the sleeves and pins disposed in a standard pattern with a specific location for each power conductor and the ground conductor. This is a disadvantage because a non-conductive housing is molded with cavities for electrical couplings (sleeves and pins) in specific locations per the standard pattern. This pattern is not variable. That is, the molded housing cannot be modified for use with a set of electrical couplings (sleeves and pins) of a different rating. Further, one non-conductive housing includes a cavity for a contact assembly that corresponds to the specific number of electrical couplings (sleeves and pins) in specific locations. Thus, a manufacturer must design and make a number of housings and contact assemblies; one for each power connector rating.

There is, therefore, a need for a power connector wherein a single housing assembly and a single contact assembly can be used with electrical couplings (sleeves and pins) that are configured for different ratings.

SUMMARY OF THE INVENTION

These needs, and others, are met by at least one embodiment of the disclosed and claimed concept which provides a power connector receptacle including a housing assembly and a clockable contact assembly. The housing assembly includes a first housing including a hollow, elongated body. The first housing body is structured to be coupled to the number of first electrical couplings disposed in a variable standard pattern. The clockable contact assembly is structured to be disposed substantially within the housing assembly first housing body and coupled thereto in one of a plurality of possible orientations.

Thus, the first housing body is structured to be coupled to the number of first electrical couplings disposed in a variable standard pattern and the clockable contact assembly is structured to be disposed substantially within the housing assembly first housing body and coupled thereto in one of a plurality of possible orientations. This configuration solves the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
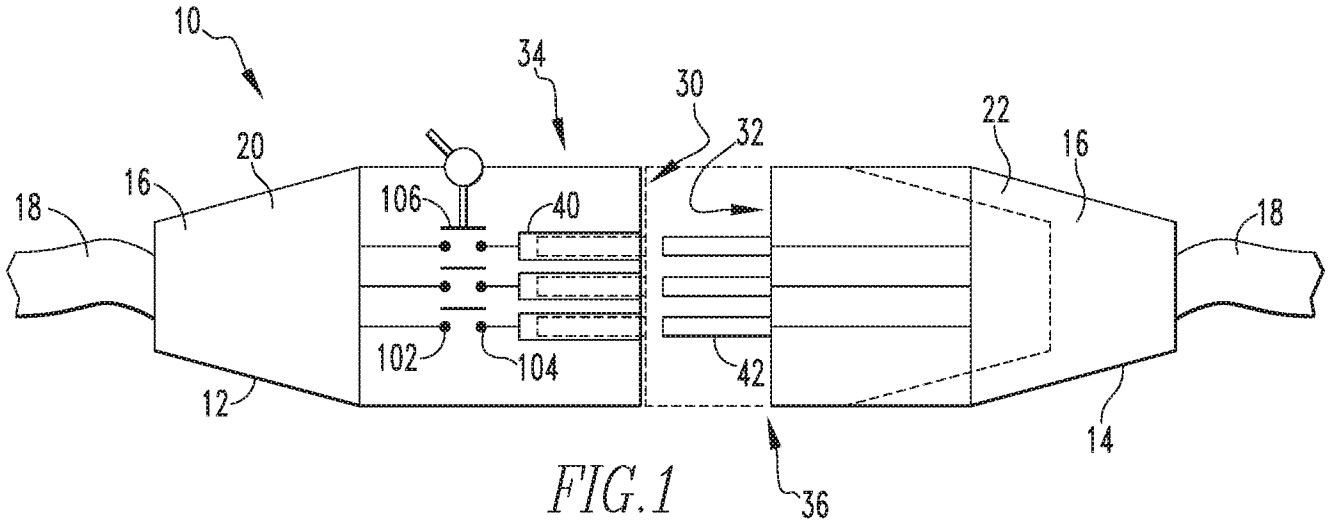
FIG. 1 is a simplified view of a power connector.

A description of power connectors is provided in U.S. patent application Ser. No. 15/331,960, the figures and detailed description of which are incorporated by reference.

For purposes of the description hereinafter, directional phrases used herein such as, for example, "clockwise," "counterclockwise," "up," "down," and derivatives thereof shall relate to the disclosed concept, as it is oriented in the drawings. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

As used herein, the term "number" shall mean one or an integer greater than one (i.e., a plurality).

As used herein, the singular form of "a," "an," and "the" include plural references unless the context clearly dictates otherwise.

As used herein, the term "conductor" shall mean a member, such as a copper conductor, an aluminum conductor, a suitable metal conductor, or other suitable material or object that permits an electric current to flow easily.

As used herein, the statement that two or more parts are "connected" or "coupled" together shall mean that the parts are joined together either directly or joined through one or more intermediate parts. As used herein, "directly coupled" or "directly connected" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, the statement that two or more parts or components "engage" one another shall mean that the parts touch and/or exert a force against one another either directly or through one or more intermediate parts or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. Further, as used herein, "loosely correspond" means that a slot or opening is sized to be larger than an element disposed therein. This means that the increased size of the slot or opening is intentional and is more than a manufacturing tolerance. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." When used in association with an electrical current, a "path" includes the elements through which the current travels.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, the word "unitary" means a component that is created as a single piece or unit. That is, a component that includes pieces that are created separately and then coupled together as a unit is not a "unitary" component or body.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally" means "in a general manner" relevant to the term being modified as would be understood by one of ordinary skill in the art.

As used herein, "substantially" means for the most part, by a large amount or degree, as would be understood by one of ordinary skill in the art. Thus, for example, a first element "substantially" disposed in a second element is, for the most part, disposed in the second element.

As shown in FIG. 1, a power connector 10 includes a line-side, first receptacle 12 and a load-side, second receptacle 14. As is known, the first receptacle 12 is coupled to, and in electrical communication with, a power source (not shown). The second receptacle 14 is coupled to, and in electrical communication with, a load (not shown). The first receptacle 12 is selectably, or removably, coupled to the second receptacle 14. Generally, power connector 10 includes a non-conductive housing assembly 16 and conductive elements, discussed in detail below. The housing assembly 16 includes a first housing 20 for the first receptacle 12 and a second housing 22 for the second receptacle 14. Generally, the first housing 20 and the second housing 22 have a generally corresponding shape which are, in an exemplary embodiment, generally cylindrical. A number of conductors (not shown) are disposed in a non-conductive cord 18 that extends from each receptacle 12, 14. Generally, the first housing 20 and the second housing 22 taper toward the respective cord 18. On each housing 20, 22 the side opposite the cord is the first housing coupling interface 30 and the second housing coupling interface 32, i.e., where the receptacles 12, 14 are coupled. When the housings 20, 22 are generally cylindrical, the coupling interfaces 30, 32 are generally circular. That is, the first and second receptacles 12, 14, i.e., the first and second housings 20, 22 move between a first position, wherein the first and second receptacles 12, 14 are spaced from each other, and a second position, wherein the first and second receptacles 12, 14 are coupled.

Further, each receptacle 12, 14 includes a conductor assembly (not numbered) that includes first and second electrical couplings 34, 36, respectively. When the receptacle 12, 14 are in the second position, the electrical couplings 34, 36 are coupled and in electrical communication. In an exemplary embodiment, the separable electrical couplings 34, 36 include hollow sleeves 40 and pins 42. As is known, the pins 42 correspond to the sleeves 40 and slide, snuggly, into the sleeves 40. As noted above, the configuration of the sleeves 40 and pins 42 are standardized and vary depending upon the rating of the power connector 10. Further, as also noted above, the position of the sleeves 40 and pins 42 on the generally circular coupling interface 30, 32 are identified by a position generally corresponding to the position of numbers on a clock. That is, a particular sleeve 40 and the associated pin 42 are disposed, for example, at "three o'clock."

As detailed below, one receptacle 12 includes a contact assembly 100. The remainder of this disclosure relates to the receptacle 12 including the contact assembly 100. In an exemplary embodiment, the receptacle 12 that includes a contact assembly 100 is the line-side receptacle 12 and the following discussion is addressed to a line-side receptacle 12. It is understood, however, that the disclosed concept could be used in a load-side receptacle 14 if the load-side receptacle 14 included a contact assembly 100. Further, as discussed in detail below, the contact assembly 100 is a variable orientation contact assembly 100' and/or a clockable contact assembly 100".

Generally, the contact assembly 100 includes a number of line-side contacts 102, a number of load-side contacts 104, a number of movable conductor members 106, a carrier housing (or contact assembly frame) 108 and an operating mechanism 110. Generally, the line-side contacts 102, the number of load-side contacts 104, the number of movable conductor members 106 and the operating mechanism 110 are coupled, or movably coupled, to the carrier housing 108. The line side contacts 102 are coupled to, and in electrical communication with the power source via the conductors (not shown) in the cord 18. The load-side contacts 104 are coupled to, and in electrical communication with, the first electrical couplings 34, i.e., sleeves 40. That is, each load-side contact 104 is coupled to, and in electrical communication with one associated sleeve 40. There is one movable conductor member 106 associated with each pair of line-side contacts 102 and load-side contacts 104. Each movable conductor member 106 is structured to, and does, move between a first position, wherein the associated line-side contact 102 and the associated load-side contact 104 are not in electrical communication (i.e., the movable conductor member 106 is spaced from the line-side contact 102 and the associated load-side contact 104), and a second position, wherein associated line-side contact 102 and the associated load-side contact 104 are electrically in electrical communication. The operating mechanism 110 is structured to move the movable conductor members 106. That is, the operating mechanism 110 is structured to, and does, move between a first position and a second position wherein, when the operating mechanism 110 is in the first position, the movable conductor members 106 are in their first position, and, when the operating mechanism 110 is in the second position, the movable conductor members are in their second position. Additional elements of the contact assembly 100 are discussed below.

As noted above, prior art housings were molded to accept a contact assembly and a set of electrical couplings disposed in a set configuration for a selected power connector rating. The disclosed concept provides for a first housing 20 that is structured to be coupled to a number of first electrical couplings 34 disposed in a "variable standard pattern," a "very variable standard pattern," an "exceptionally variable standard pattern," or an "exceedingly variable standard pattern," as those terms are defined below.

As used herein, a "variable standard pattern" means first electrical couplings 34 are disposed in a number of standard patterns for at least three different amperages selected from the group consisting of 16 amp, 20 amp, 30 amp, 32 amp, 60 amp, 63 amp, and 125 amp; that is, to be "structured to be coupled to a number of first electrical couplings disposed in a variable standard pattern," as used herein, the first housing 20 is structured to accommodate at least one standard pattern for power connectors for at least three different amperages selected from the group above. It is noted that some prior art housings are structured to accommodate electrical couplings for closely similar amperages. For example, some electrical couplings for 16 amp and electrical couplings for 20 amp connectors may use the same housing. This is because the electrical couplings are almost identical in size and configuration. Accordingly, as used herein, a housing that only accommodates similar electrical couplings is not structured to be coupled to a number of first electrical couplings 34 disposed in a "variable standard pattern." As used herein, "similar electrical couplings" means electrical couplings structured to accommodate either amperage in the following pairs of amperages: 16 amp and 20 amp, 30 amp and 32 amp, 60 amp and 63 amp, and 100 amp and 125 amp. That is, for example, a housing structured to accommodate electrical couplings for both a 30 amp electrical connector and a 32 amp electrical connector is not, as used herein, structured to be coupled to a number of first electrical couplings disposed in a variable standard pattern."

Further, as used herein, the disclosed concept provides for a first housing 20 that is structured to be coupled to a number of first electrical couplings 34 disposed in a very variable standard pattern. As used herein, a "very variable standard pattern" means first electrical couplings 34 are disposed in a number of standard patterns for at least four different amperages selected from the group consisting of 16 amp, 20 amp, 30 amp, 32 amp, 60 amp, 63 amp, and 125 amp. Further, as used herein, the disclosed concept provides for a first housing 20 that is structured to be coupled to a number of first electrical couplings 34 disposed in an exceptionally variable standard pattern. As used herein, an "exceptionally variable standard pattern" means first electrical couplings 34 are disposed in a number of standard patterns for at least five different amperages selected from the group consisting of 16 amp, 20 amp, 30 amp, 32 amp, 60 amp, 63 amp, and 125 amp. Further, as used herein, the disclosed concept provides for a first housing 20 that is structured to be coupled to a number of first electrical couplings 34 disposed in an exceedingly variable standard pattern. As used herein, an "exceedingly variable standard pattern" means first electrical couplings 34 are disposed in a number of standard patterns for at least six different amperages selected from the group consisting of 16 amp, 20 amp, 30 amp, 32 amp, 60 amp, 63 amp, and 125 amp.

The standard patterns for the electrical couplings 34, i.e., the sleeves 40, are well known in the art. Thus, as used herein, "a first housing 20 structured to be coupled to the number of first electrical couplings disposed in a variable standard pattern" means that the first housing 20 is structured to be coupled to electrical couplings 34 in more than two standard patterns. Further, as used herein, "a first housing 20 structured to be coupled to the number of first electrical couplings disposed in a very variable standard pattern" means that the first housing 20 is structured to be coupled to electrical couplings 34 in more than three standard patterns. Further, as used herein, "a first housing 20 structured to be coupled to the number of first electrical couplings disposed in an exceptionally variable standard pattern" means that the first housing 20 is structured to be coupled to electrical couplings 34 in more than four standard patterns. Further, as used herein, "a first housing 20 structured to be coupled to the number of first electrical couplings disposed in an exceedingly variable standard pattern" means that the first housing 20 is structured to be coupled to electrical couplings 34 in more than five standard patterns.

Figure 6:
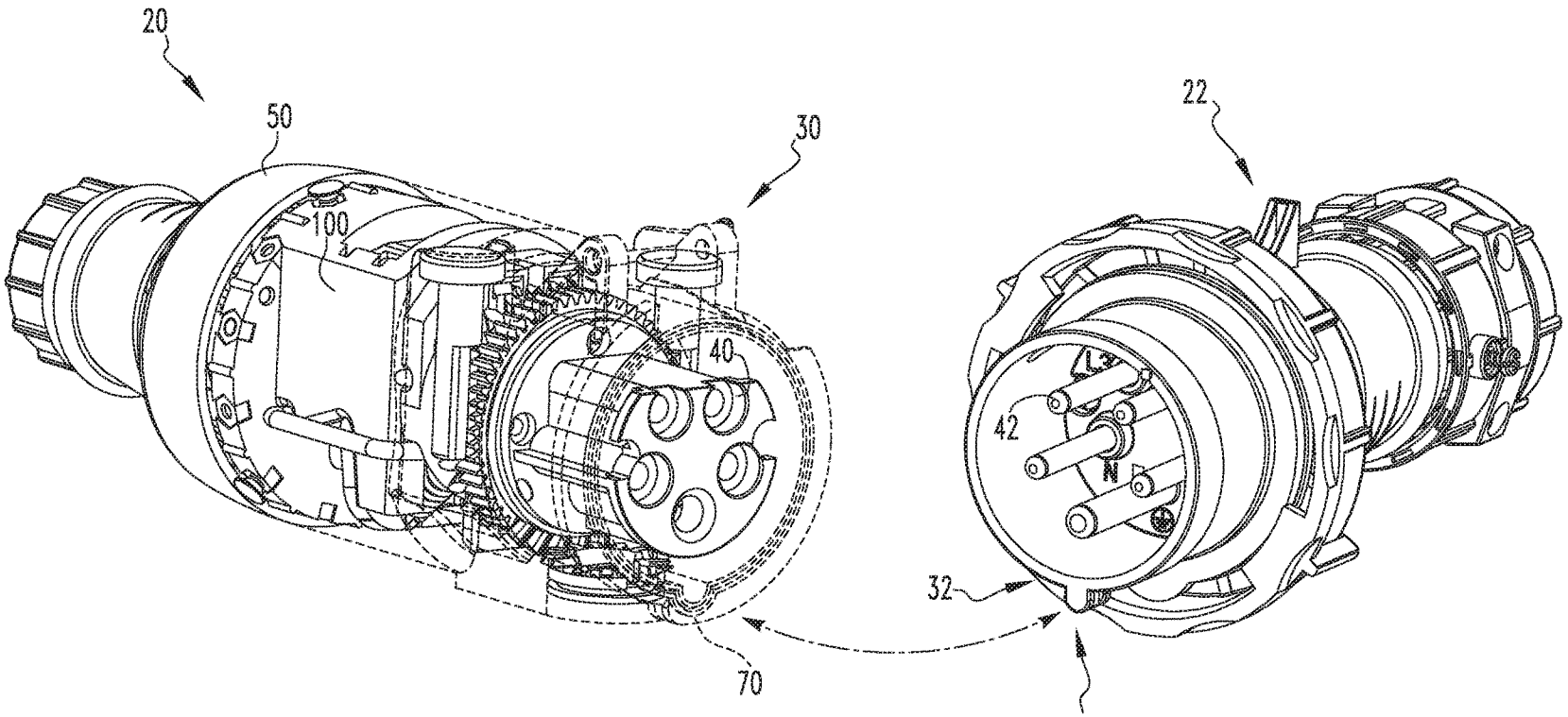
FIG. 6 is an isometric view of a power connector with a selected rating.
Figure 7:
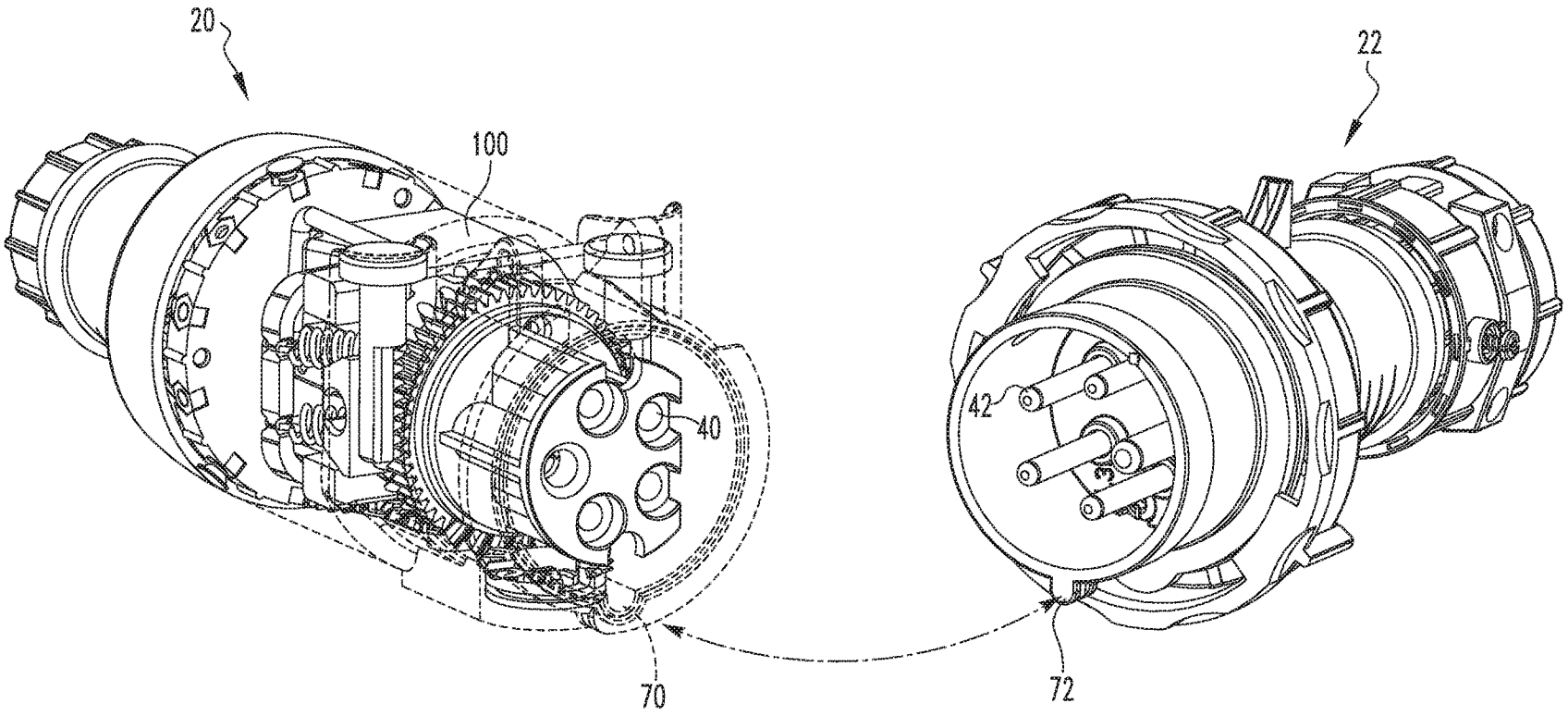
FIG. 7 is an isometric view of a power connector with another selected rating.

Further, as is known, the first and second electrical couplings 34, 36 are disposed in a selected pattern associated with a selected rating. Two examples of the selected patterns are shown in FIGS. 6 and 7; it is however, understood that electrical couplings 34, 36 in other patterns for other ratings exist. It is further noted that each pattern of electrical couplings 34, 36 includes a ground coupling 34', 36'. That is, the other electrical couplings 34, 36 are positioned relative to the ground coupling 34', 36' in a standard pattern or set or positions. As discussed below, the proper orientation for the electrical couplings 34, 36 relative to the first housing 20 (or second housing 22) is achieved by positioning the ground coupling 34', 36' at a selected position relative to the keyway 70, discussed below. The various patterns of electrical couplings 34, 36 and the location of the ground coupling 34', 36' for each rating are known in the art.

Figure 2:
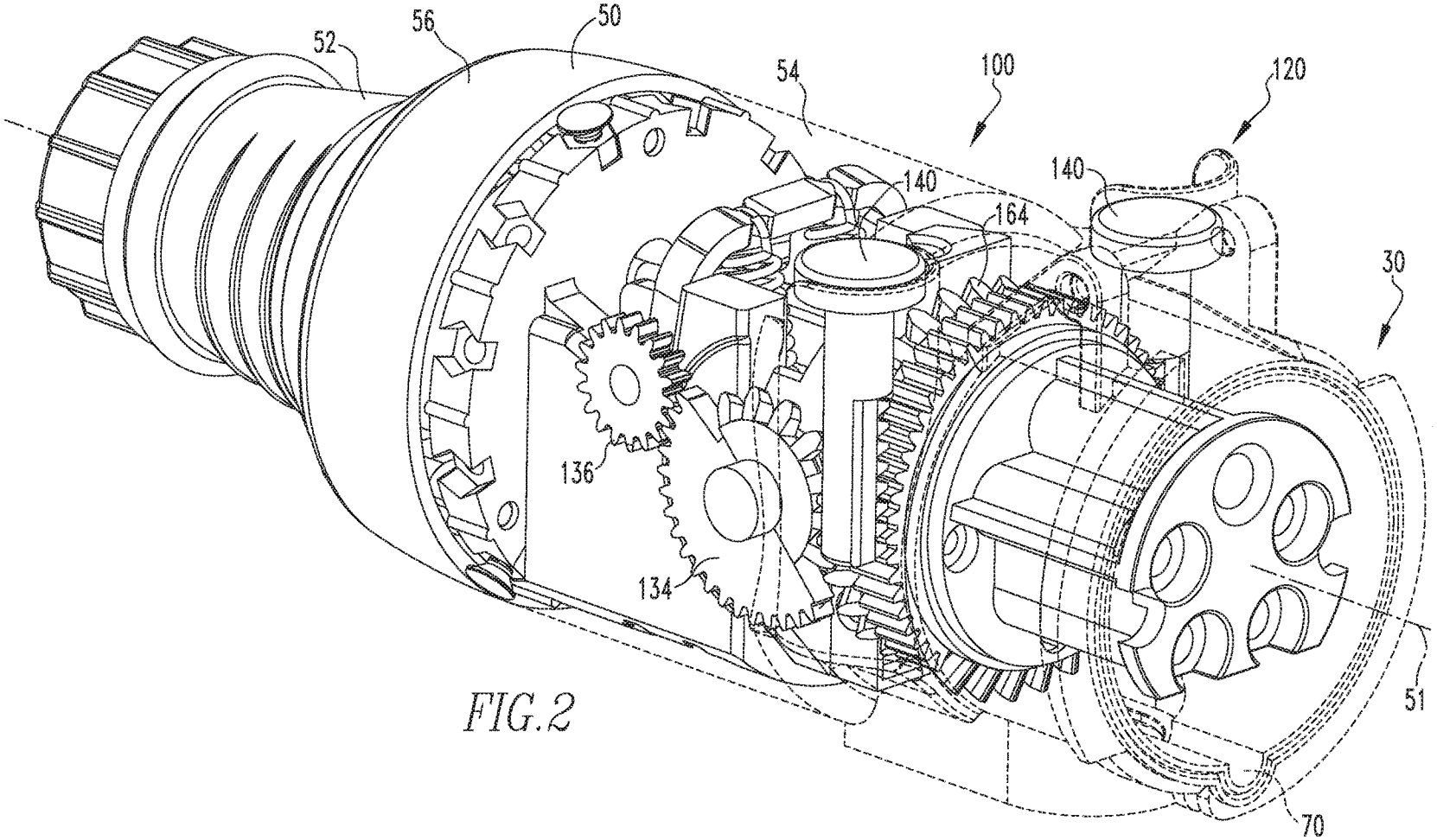
FIG. 2 is an isometric, partial cross-sectional view of a first receptacle.
Figure 3:
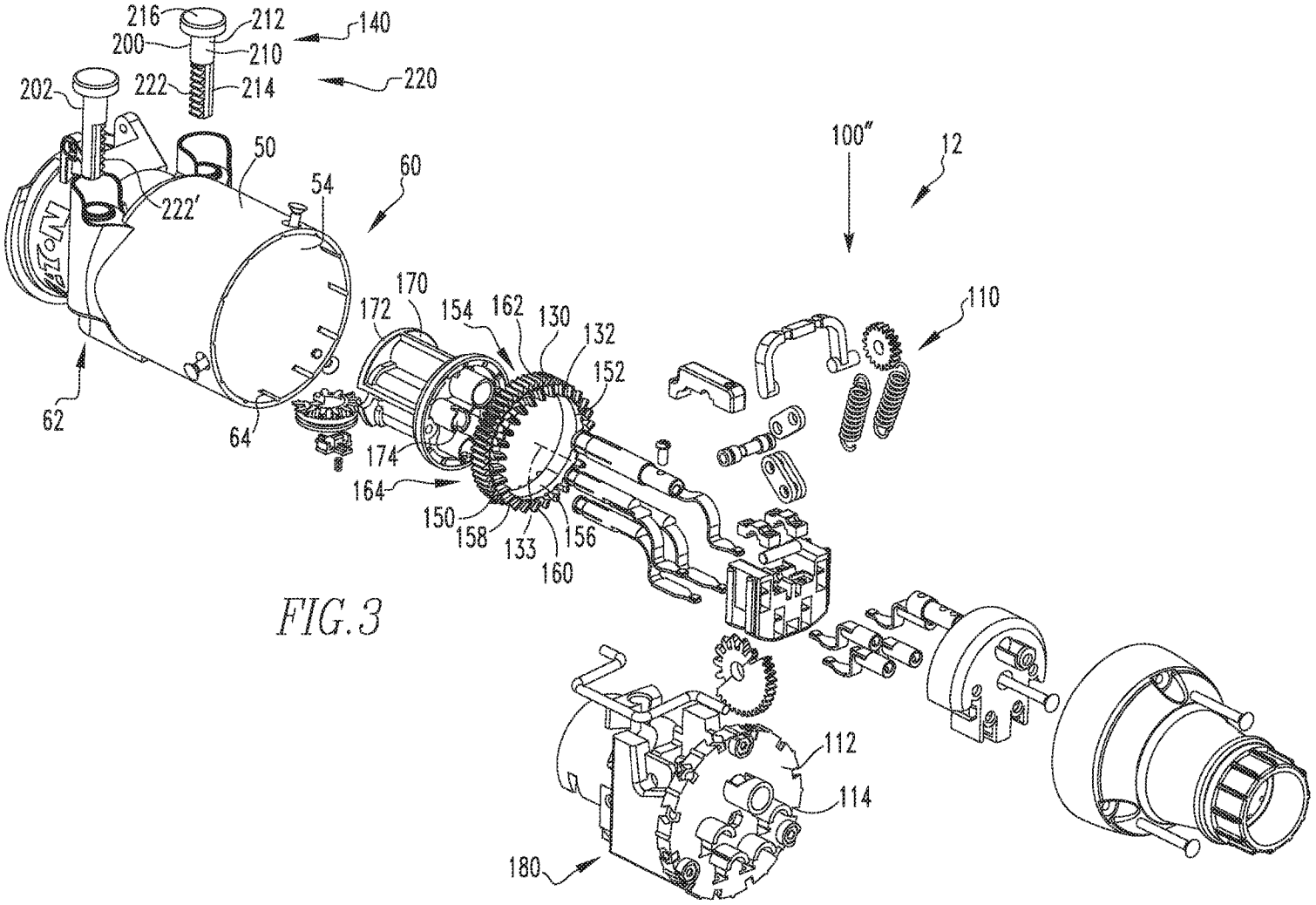
FIG. 3 is an exploded isometric view of a first receptacle.

In an exemplary embodiment, as shown in FIGS. 2 and 3, first housing 20 includes an elongated body 50 and a cap 52. The first housing body 50 is, in an exemplary embodiment, generally cylindrical that is open on both ends. Thus, the first housing body 50 defines an enclosed space and has a longitudinal axis 51. The cap 52 is tapered with one end generally the size of first housing body 50 and the other end about the size of cord 18. The cap 52 is structured to be, and is, coupled to first housing body 50. The first housing body 50 includes an inner surface 54 and an outer surface 56. In an exemplary embodiment, the first housing body inner surface 54 also includes an indicia (not shown). The indicia is a marking that indicates an orientation for a clockable contact assembly 100, as discussed below. Alternatively, the clockable contact assembly 100 is oriented relative to the housing based on a reference image such as, but not limited to, FIG. 5, discussed below.

Further, the first housing, i.e., the first housing body 50, includes a keyway 70 (FIG. 2). The keyway 70 is a longitudinally extending groove disposed on the housing body inner surface 54 at the first housing coupling interface 30. As shown in FIG. 6, the second housing 22, i.e., a second housing body 24, includes a key 72. The key 72 is sized and shaped to correspond to the keyway 70 and extends generally longitudinally on the second housing body inner surface (not numbered). It is understood that the first and second housings 20, 22 can only be brought into the second position, i.e., be coupled, when the key 72 is aligned with, and moves into, the keyway 70. Further, the keyway 70 is a fixed reference point and, as used herein, is disposed at the six o'clock position. That is, all other clock positions are based on the location of the keyway 70 as the six o'clock position.

The first housing body 50 also includes a variable orientation contact assembly mounting 60 (FIG. 3). The variable orientation contact assembly mounting 60 is structured to be, and is, coupled to a clockable contact assembly 100. That is, as used herein, a "variable orientation contact assembly mounting" is a mounting structured to be coupled to a clockable contact assembly 100 and wherein the clockable contact assembly 100 is disposed in one of several selectable orientations. The variable orientation contact assembly mounting 60 also includes a number of actuator member mountings 62. In an exemplary embodiment, the number of actuator member mountings 62 are generally tangential passages through the first housing body 50. The first housing body inner surface 54 includes a number of generally axially extending ridges 64, which are also part of the variable orientation contact assembly mounting 60. The ridges 64 are structured to engage, or be engaged by, the mounting disk 112, described below.

The common elements of the contact assembly 100 are described above and additional elements are described in U.S. patent application Ser. No. 15/331,960, the detailed description of which is incorporated by reference. In relation to the disclosed and claimed concept, the contact assembly 100 is a "variable orientation contact assembly" 100'. As used herein, a "variable orientation contact assembly" means a contact assembly that is structured to be, and is, disposed in a generally hollow power connector housing in any of a plurality of orientations relative to the housing. As used herein, a "plurality of orientations relative to the housing" means that the variable orientation contact assembly 100' may be rotated about a number of axes and be installed in the housing in any orientation relative to the axes. Further, in an exemplary embodiment, the contact assembly 100 is a "clockable contact assembly" 100". As used herein, a "clockable contact assembly" means a contact assembly that is structured to be, and is, disposed in a power connector housing in any of a plurality of orientations relative to an axis of rotation of a generally hollow, cylindrical housing. That is, a generally hollow, cylindrical housing is defined by a body that extends about an axis of rotation and the "clockable contact assembly" is structured to be installed in a plurality of orientations about the axis of rotation of the body (or assembly). As used herein, "in a plurality of orientations about the axis of rotation of the body" means that the "clockable contact assembly" may be rotated about a single axis that extends generally parallel to the longitudinal axis of the body (or assembly). Hereinafter, the following description refers to a "contact assembly 100" but it is understood that the identification of a "contact assembly 100" also includes, in an exemplary embodiment, a variable orientation contact assembly 100' as well as a clockable contact assembly 100".

The contact assembly 100 includes the number of first electrical couplings 34, the number of line-side contacts 102, the number of load-side contacts 104, the number of movable conductor members 106, and the operating mechanism 110 discussed above. Further, the number of first electrical couplings 34 are structured to be, and are, disposed in any of the various standard patterns. As used herein, "electrical couplings 34 [that] are structured to be [and are] disposed in any of the various standard patterns" (or a "number of first electrical couplings 34 structured to be [and are] disposed in any of the various standard patterns") means that the electrical couplings 34 are structured to be, and are, disposed in one of a plurality of configurations and are still coupleable to one of the line-side contacts 102 or one of the load-side contacts 104 of the contact assembly 100 and wherein the operating mechanism 110 is structured to be, and is, actuated by a clockable actuating assembly 120, discussed below. Conversely, and as used herein, a prior art first set of electrical couplings coupled to a first contact assembly and a prior art second set of electrical couplings coupled to a second contact assembly each disclose electrical couplings structured to be coupled to a one of the line-side contacts or the number of load-side contacts of the contact assembly in a "single" standard pattern and wherein the operating mechanism is not structured to be, and is not, actuated by a clockable actuating assembly. Such "single" standard pattern electrical couplings are not, as used herein, "electrical couplings 34 [that] are structured to be disposed in any of the various standard patterns." Further, each first electrical coupling 34 is structured to be, and is, coupled to, and in electrical communication with, one of the line-side contacts 102 or one of the load-side contacts 104.

Further, in an exemplary embodiment, the contact assembly 100 includes a clockable actuating assembly 120. The clockable actuating assembly 120 is also described herein as part of the operating mechanism 110. That is, like the operating mechanism 110, the clockable actuating assembly 120 is structured to, and does, move the number of movable conductor members 106 between the first and second positions. Stated alternately, the clockable actuating assembly 120 is structured to be, and is, operatively coupled to the operating mechanism 110. Alternatively, if the clockable actuating assembly 120 is identified as part of the operating mechanism 110, the clockable actuating assembly 120 is structured to be, and is, operatively coupled to the movable conductor members 106.

In an exemplary embodiment, the clockable actuating assembly 120 includes a number of gears 130 and a number of actuator members 140. Each actuator member 140 is structured to be, and is, operatively coupled to an actuating assembly gear 130 and vice-versa. In an exemplary embodiment, the number of gears 130 includes a first gear 132 structured to be operatively coupled to the number of actuator members 140. Further, the number of gears 130, and first gear 132, is/are operatively coupled to the number of movable conductor members 106.

As shown in FIGS. 2 and 3, and in an exemplary embodiment, clockable actuating assembly 120 includes a first (open/off) push button 200, a second (close/on) push button 202 (which are, in this embodiment, the number of actuator members 140), the first gear 132, as well as a second gear 134 and a third gear 136. In an exemplary embodiment, the clockable actuating assembly first gear 132 is a combination gear. As used herein, a "combination gear" is a gear that includes a plurality of different sets of teeth. As shown in FIG. 3, the clockable actuating assembly first gear 132 is a ring gear, i.e., a generally toroid body 150 having a first axial side 152, a second axial side 154, a radial inner side 156, and a radial outer side 158. As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can.

The clockable actuating assembly first gear first axial side 152 includes bevel gear teeth 160 which, in an exemplary embodiment, are angled outwardly from the center of the clockable actuating assembly first gear body 150. The clockable actuating assembly first gear outer side 158 includes spur gear teeth 162. In an exemplary embodiment wherein the power connector includes an interlock assembly, as disclosed in U.S. patent application Ser. No. 15/331,960, the clockable actuating assembly first gear second axial side 154 also includes bevel gear teeth 164. That is, the clockable actuating assembly first gear second axial side 154 is structured to operatively engage an interlock assembly (not shown). The various teeth 162, 164 extend over one of an arc, or, over the circumference of the clockable actuating assembly first gear body 150. The clockable actuating assembly first gear inner side 156 is generally smooth.

The clockable actuating assembly first gear 132 is rotatably coupled to the carrier housing 108 and generally extends about, i.e., encircling, the housing longitudinal axis 51. The carrier housing 108, in an exemplary embodiment, includes a generally circular channel (not shown) that is a mounting for the clockable actuating assembly first gear 132. Thus, the clockable actuating assembly first gear 132 has an axis of rotation 133 that is generally aligned with, or parallel to, the housing longitudinal axis 51. Further, the clockable actuating assembly first gear 132 is structured to be, and is, disposed about one of the operating mechanism 110, the number of first electrical couplings 34, or both the operating mechanism 110 and the number of first electrical couplings 34. The second gear 134 and third gear 136 are described in U.S. patent application Ser. No. 15/331,960. For this disclosure it is noted that the clockable actuating assembly first gear 132 is operatively coupled to the second gear 134, and, the second gear 134 is operatively coupled to the operating mechanism 110.

The clockable actuating assembly first and second push buttons 200, 202 are substantially similar and only the first push button 200 will be described. Thereafter, any description of the second push button 202 will use the same reference numbers followed by a single prime (') indication. The first push button 200 includes an elongated body 210 having a first end 212 and a second end 214. As shown in FIG. 3, the first push button body first end 212, in an exemplary embodiment, includes an enlarged portion 216, i.e., a portion with a cross-section that is larger than the other portions of the first push button body 210. The first push button body second end 214 includes a rack 220. The first push button body rack 220 includes a number of teeth 222 that are structured to operatively engage, or be engaged by, the clockable actuating assembly first gear 132 and, in an exemplary embodiment, the clockable actuating assembly first gear outer side spur gear teeth 162. It is noted that, because the clockable actuating assembly first gear outer side spur gear teeth 162 extend about the clockable actuating assembly first gear body 150, the actuator members 140, i.e., push buttons 200, 202, are structured to operatively engage the clockable actuating assembly first gear 132 at any location. That is, the clockable contact assembly 100", is structured to operatively engage, or be engaged by, the push buttons 200, 202 regardless of the orientation of the clockable contact assembly 100" relative to the first housing body 50. This configuration solves the problems stated above.

Further, the carrier housing 108 includes a mounting disk 112. The plane of mounting disk 112 extends generally perpendicularly to the first housing body longitudinal axis 51. The radial surface of the mounting disk 112 includes a number of axial grooves 114. The axial grooves correspond in position to the first housing body inner surface ridges 64. It is noted that the first housing body inner surface ridges 64 and the mounting disk axial grooves 114 are generally evenly spaced. In this configuration, the mounting disk 112 is structured to be coupled to the first housing body inner surface ridges 64, and therefore the first housing body 50, in a number of orientations.

Further, in an exemplary embodiment, the contact assembly 100 includes a support for the electrical couplings 34. In an exemplary embodiment, where the electrical couplings 34 are sleeves 40, the contact assembly 100 includes a sleeve support 170 which, in this embodiment includes a generally cylindrical body 172 defining a number of longitudinal passages 174. The sleeve support body passages 174 generally correspond to the sleeves 40 and the sleeves 40 are disposed within the sleeve support body passages 174. The sleeve support 170 is coupled, directly coupled, or fixed to the carrier housing 108.

Thus, the clockable actuating assembly 120 allows the contact assembly 100 to be inserted into and coupled, directly coupled, or fixed to the first housing body 50 in a plurality of orientations. Further, a contact assembly 100 that is structured to be positioned in and coupled to a first housing body 50 in more than two orientations is, as used herein, a "variable orientation contact assembly" 100. A contact assembly 100 that is structured to be positioned in and coupled to a first housing body 50 in more than three orientations is, as used herein, a "very variable orientation contact assembly" 100. A contact assembly 100 that is structured to be positioned in and coupled to a first housing body 50 in more than four orientations is, as used herein, an "exceptionally variable orientation contact assembly" 100. A contact assembly 100 that is structured to be positioned in and coupled to a first housing body 50 in more than five orientations is, as used herein, an "exceedingly variable orientation contact assembly" 100. The contact assembly 100 described above is any one of a variable orientation contact assembly 100, a very variable orientation contact assembly 100, an exceptionally variable orientation contact assembly 100, or an exceedingly variable orientation contact assembly 100.

Thus, when assembled, the contact assembly 100 includes a number of first electrical couplings 34 disposed in one of the various standard patterns. The contact assembly 100 is disposed substantially within the first housing body 50. Moreover, the contact assembly 100 is disposed in a selected orientation, or clockable orientation, substantially within the first housing body 50. That is, a "clockable orientation" contact assembly 100, as used herein, means a contact assembly 100 that is structured to be, and/or is, disposed in a power connector housing body 50 in two or more orientations relative to an axis of rotation of a generally hollow, cylindrical housing. As used herein, a "very clockable orientation" contact assembly 100 means a contact assembly 100 structured to be, and/or is, disposed in a power connector housing body 50 in three or more orientations relative to an axis of rotation of a generally hollow, cylindrical housing. As used herein, an "exceptionally clockable orientation" contact assembly 100 means a contact assembly 100 is structured to be, and/or is, disposed in a power connector housing body 50 in three or more orientations relative to an axis of rotation of a generally hollow, cylindrical housing. As used herein, an "exceedingly clockable orientation," as used herein, means a contact assembly 100 structured to be, and/or is, disposed in a power connector housing body 50 in four or more orientations relative to an axis of rotation of a generally hollow, cylindrical housing. The contact assembly 100 described above is any one of a clockable orientation contact assembly 100, a very clockable orientation contact assembly 100, an exceptionally clockable orientation contact assembly 100, or an exceedingly clockable orientation contact assembly 100.

Figure 4:
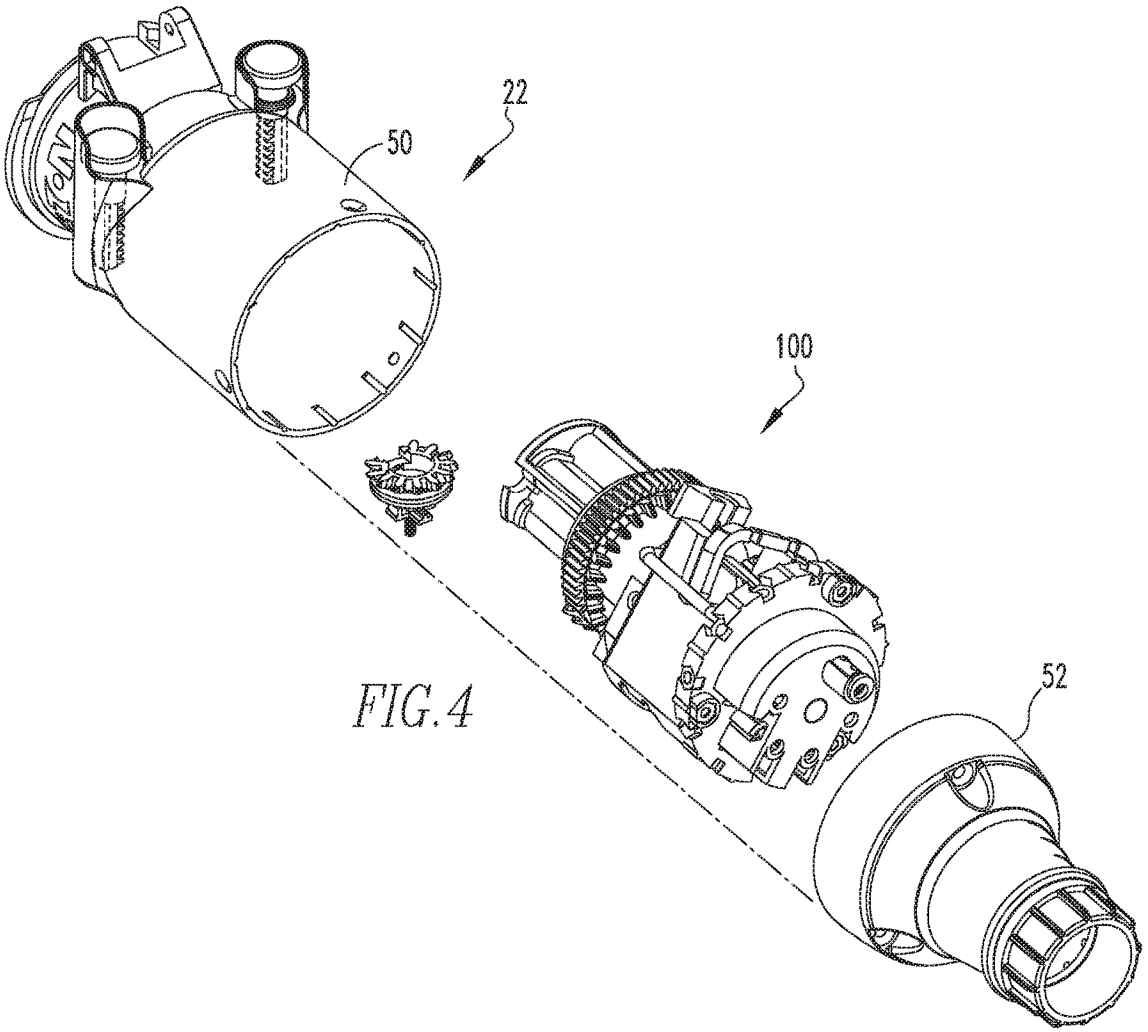
FIG. 4 is an exploded view of a first receptacle.

The following description, with reference to FIGS. 4-7, discusses the insertion and clocking of a contact assembly 100. The contact assembly 100 is assembled as described above. As shown in FIG. 4, the first housing body 50 and the cap 52 are separated. The contact assembly 100 is positioned to be installed in the first housing body 50. That is, the contact assembly 100 is positioned along the first housing body longitudinal axis 51. The contact assembly 100 is then moved axially to be partially in the first housing body 50. At this point, the contact assembly 100 is positioned, or "clocked," depending upon its rating.

Figure 5:
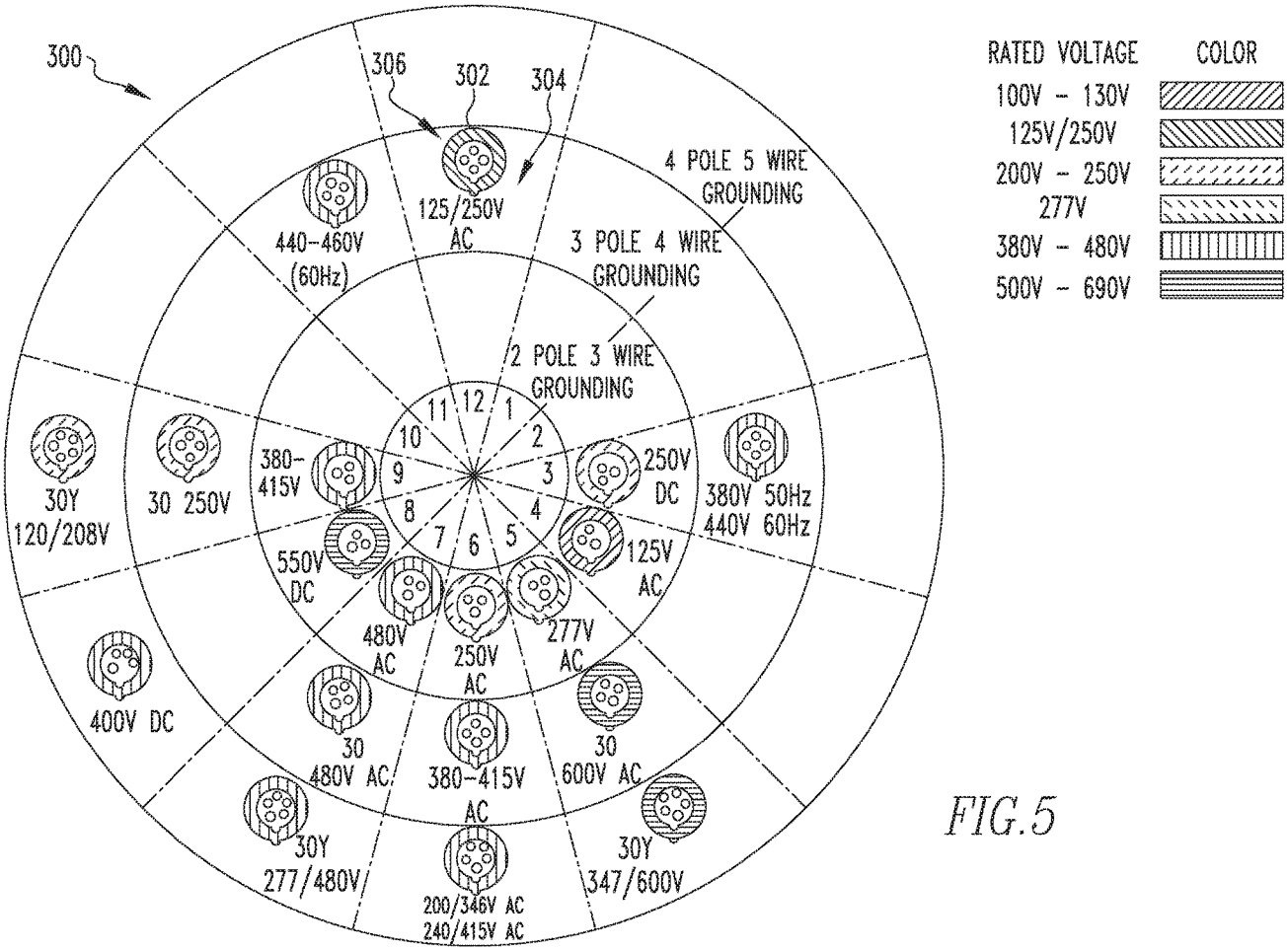
FIG. 5 is a map showing the position of a ground coupling for receptacles with different ratings.

That is, FIG. 5 is a map 300 showing the position of the ground coupling 34' for electrical couplings 34 of various ratings. On FIG. 5, a number of power connectors are shown. For example, the map 300 includes a number of power conductor indicia 302. Each power conductor indicia 302 includes a power indicia 304, e.g., 250 V[olts] AC, as well as a graphical representation 306 of a number of wires (or conductors). Further, each power conductor indicia 302 is disposed at a specific location, i.e., at a specific clock position. For example, the power conductor indicia 302 for a power connector 10 with a rating of "four wire, 250 volt, alternating current" is disposed at the "twelve o'clock" position. Further, each power conductor indicia 302 represents the location for the ground coupling 34' for a power connector 10 of the identified rating. Thus, to orient a contact assembly 100 in a first housing 20, or first housing body 50, the ground coupling 34' is positioned at the location indicated. Because the other electrical couplings 34 are in a predetermined position relative to the ground coupling 34', all electrical couplings 34 are then positioned in their proper location for the selected rating.

For example, as shown in FIG. 6, a power connector 10, i.e., a contact assembly 100, with a rating of 4 wires, 240 volts, AC is provided. Thus, after the contact assembly 100 is inserted into the first housing 20, as discussed above, a user would look to the map 300 and observe that the ground coupling 34' for a power connector 10, i.e., a contact assembly 100, with this rating is disposed at the "six o'clock" position. Thus, the user would rotate the contact assembly 100 so that the ground coupling 34' is at the "six o'clock" position and fully insert the contact assembly 100 in the first housing body 50. Full insertion of the contact assembly 100 in the first housing body 50 moves the ridges 64 into the mounting disk axial grooves 114. Further, the push button body racks 220, 220' mesh with the clockable actuating assembly first gear outer side spur gear teeth 162 (and are positioned to operatively engage the clockable actuating assembly first gear outer side spur gear teeth 162). In this configuration, the contact assembly 100 cannot be further reoriented. That is, the contact assembly 100 is in its final position. The contact assembly 100 is, in an exemplary embodiment, further secured with a fastening device (not shown) such as an adhesive or mechanical fasteners.

Alternatively, the same first housing 20 is structured to be coupled to a contact assembly 100 with a different rating. That is, as shown in FIG. 7, a power connector 10, i.e., a contact assembly 100, with a rating of 4 wires, 120 volts, AC is provided. As before, the user consults map 300, or a similar guide, to determine that for a power connector 10 with this rating, the ground coupling 34' is disposed at the "nine o'clock" position. Thus, the user, after inserting the contact assembly 100 into the first housing body 50 as described above, rotates the contact assembly 100 so that the ground coupling 34' is disposed at the "nine o'clock" position. The contact assembly 100 is then secured in the first housing 20 as described above. Thus, the housing assembly 16, and in an exemplary embodiment, the first housing assembly 20, is structured to be, and is, coupled to a contact assembly 100 (or variable orientation contact assembly 100' or clockable contact assembly 100") having various ratings; that is, the first housing 20 is structured to be coupled to a number of first electrical couplings 34 disposed in any of the various standard patterns. This solves the problems stated above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A housing assembly for a power connector, said power connector including a number of line-side conductors, a clockable contact assembly, including a number of line-side contacts, a number of load-side contacts, a number of movable conductor members, and an operating mechanism, each conductor member associated with one line-side contact and one load-side contact, each said conductor member movable between a first position, wherein said associated line-side contact and said associated load-side contact are not in electrical communication, and a second position, wherein said associated line-side contact and said associated load-side contact are electrically in electrical communication, each said line-side contact coupled to, and in electrical communication with, an associated line-side conductor, said operating mechanism structured to move between a first position and a second position and to move said movable conductor members between the first and second positions wherein, when said operating mechanism is in said first position, said movable conductor members are in the first position, and, when said operating mechanism is in said second position, said movable conductor members are in the second position, a number of first electrical couplings, each first electrical coupling coupled to, and in electrical communication with, a line-side contact, said number of first electrical couplings disposed in any of a variable standard pattern, said housing assembly comprising:

a first housing including a hollow, elongated body; and said first housing body structured to be coupled to said number of first electrical couplings disposed in a variable standard pattern.

2. The housing assembly of claim 1 wherein:

said first housing body includes a variable orientation contact assembly mounting;

said variable orientation contact assembly mounting structured to be coupled to said clockable contact assembly; and wherein said first housing body is structured to be coupled to said clockable contact assembly with said clockable contact assembly in one of a number of selectable clockable orientations.

3. The housing assembly of claim 2 wherein:

said first housing body includes a first indicia; and said first indica including a number of orientation indicators, each said orientation indicator associated with one selectable clockable orientation.

4. The housing assembly of claim 3 wherein said clockable contact assembly includes an actuating assembly structured to move the number of movable conductor members between the first and second positions, said actuating assembly including a number of gears and a number of actuator members, each actuator member structured to be operatively coupled to an actuating assembly gear, said actuating assembly number of gears structured to be operatively coupled to said operating mechanism, and wherein:

said variable orientation contact assembly mounting includes a number of actuator members, each actuator member structured to be operatively coupled to an actuating assembly gear;

said first housing body includes a number of actuator member mountings; and each said actuator member movably coupled to an actuator member mounting.

5. The housing assembly of claim 4 wherein said actuating assembly number of gears includes a ring gear, wherein said actuating assembly first gear is a ring gear structured to be disposed about one of said operating mechanism, said number of first electrical couplings, or both said operating mechanism and said number of first electrical couplings and wherein:

said actuator members are structured to be operatively coupled to said ring gear; and said first housing body is structured to be rotatably coupled to said ring gear and to dispose said ring gear.

6. A clockable contact assembly for a power connector, said power connector including a housing assembly, said housing assembly including a first housing body, said first housing body including a variable orientation contact assembly mounting, said variable orientation contact assembly mounting structured to be coupled to said clockable contact assembly, and wherein said clockable contact assembly comprises:

a number of line-side contacts;

a number of load-side contacts;

a number of movable conductor members;

an operating mechanism;

each conductor member associated with one line-side contact and one load-side contact, each said conductor member movable between a first position, wherein said associated line-side contact and said associated load-side contact are not in electrical communication, and a second position, wherein said associated line-side contact and said associated load-side contact are in electrical communication, each said line-side contact coupled to, and in electrical communication with, an associated line-side conductor;

said operating mechanism structured to move between a first position and a second position and to move said conductor members between the first and second positions wherein, when said operating mechanism is in said first position, said conductor members are in the first position, wherein, when said operating mechanism is in said second position, said conductor members are in the second position;

a number of first electrical couplings, each first electrical coupling coupled to, and in electrical communication with, a line-side contact; and said number of first electrical couplings disposed in any of the various standard patterns.

7. The clockable contact assembly of claim 6 wherein:

said operating mechanism includes a clockable actuating assembly structured to move said number of movable conductor members between the first and second positions, said clockable actuating assembly including a number of gears and a number of actuator members;

each actuator member operatively coupled to an actuating assembly gear;

said number of gears includes a first gear structured to be operatively coupled to said number of actuator members; and said number of gears operatively coupled to said number of movable conductor members.

8. The clockable contact assembly of claim 7 wherein said clockable actuating assembly first gear is a ring gear structured to be disposed about one of said operating mechanism, said number of first electrical couplings, or both said operating mechanism and said number of first electrical couplings.

9. The clockable contact assembly of claim 8 wherein said clockable actuating assembly first gear is a combination gear structured to operatively engage an interlock assembly.

10. A power connector receptacle comprising:

a housing assembly including a first housing including a hollow, elongated body;

said first housing body structured to be coupled to a number of first electrical couplings disposed in a variable standard pattern;

a clockable contact assembly, said clockable contact assembly disposed substantially within said housing assembly first housing body and coupled thereto in one of a plurality of possible orientations;

said clockable contact assembly includes a number of line-side contacts, a number of load-side contacts, a number of movable conductor members, and an operating mechanism;

each conductor member associated with one line-side contact and one load-side contact, each said conductor member movable between a first position, wherein said associated line-side contact and said associated load-side contact are not in electrical communication, and a second position, wherein said associated line-side contact and said associated load-side contact are in electrical communication, each said line-side contact coupled to, and in electrical communication with, an associated line-side conductor, said operating mechanism structured to move between a first position and a second position and to move said conductor members between the first and second positions wherein, when said operating mechanism is in said first position, said conductor members are in the first position, wherein, when said operating mechanism is in said second position, said conductor members are in the second position;

a number of first electrical couplings, each first electrical coupling coupled to, and in electrical communication with, a load-side contact; and said number of first electrical couplings disposed in any of a number of standard patterns.

11. The power connector receptacle of claim 10 wherein:

said first housing body includes variable orientation contact assembly mounting;

said variable orientation contact assembly mounting includes a number of actuator member mountings;

said operating mechanism includes a clockable actuating assembly structured to move said number of movable conductor members between the first and second positions, said clockable actuating assembly including a number of gears and a number of actuator members;

each actuator member movably coupled to a variable orientation contact assembly mounting actuator member mounting and operatively coupled to an actuating assembly gear;

said number of gears includes a first gear structured to be operatively coupled to said number of actuator members; and said number of gears operatively coupled to said number of movable conductor members.

12. The power connector receptacle of claim 11 wherein said clockable actuating assembly first gear is a ring gear is disposed about one of said operating mechanism, said number of first electrical couplings, or both said operating mechanism and said number of first electrical couplings.

13. The power connector receptacle of claim 12 wherein said clockable actuating assembly first gear is a combination gear structured to operatively engage an interlock assembly.

14. The housing assembly of claim 10 wherein:

said first housing body includes a variable orientation contact assembly mounting;

said variable orientation contact assembly mounting structured to be coupled to said clockable contact assembly; and wherein said first housing body is structured to be coupled to said clockable contact assembly with said clockable contact assembly in one of a number of selectable clockable orientations.

15. The power connector receptacle of claim 14 wherein:

said first housing body includes a first indicia;

said first indica including a number of orientation indicators, each said orientation indicator associated with one selectable clockable orientation.

16. The power connector receptacle of claim 15 wherein:

said first housing body includes variable orientation contact assembly mounting;

said variable orientation contact assembly mounting includes a number of actuator member mountings;

said operating mechanism includes a clockable actuating assembly structured to move said number of movable conductor members between the first and second positions, said clockable actuating assembly including a number of gears and a number of actuator members;

each actuator member movably coupled to a variable orientation contact assembly mounting actuator member mounting and operatively coupled to an actuating assembly gear;

said number of gears includes a first gear structured to be operatively coupled to said number of actuator members; and said number of gears operatively coupled to said number of movable conductor members.

17. The power connector receptacle of claim 16 wherein:

said actuating assembly first gear is a ring gear structured to be disposed about one of said operating mechanism, said number of first electrical couplings, or said operating mechanism and said number of first electrical couplings;

said actuator members are operatively coupled to said ring gear;

said first housing body is structured to be rotatably coupled to said ring gear and to dispose said ring gear about one of said operating mechanism, said number of first electrical couplings, or said operating mechanism and said number of first electrical couplings; and said ring gear rotatably coupled to said first housing body with said ring gear disposed about one of said operating mechanism, said number of first electrical couplings, or both said operating mechanism and said number of first electrical couplings.

* * * * *